US006289197B1

(12) United States Patent
Matsumoto et al.

(10) Patent No.: US 6,289,197 B1
(45) Date of Patent: Sep. 11, 2001

(54) DEVELOPER FEEDING MEMBER WHEREIN ITS FREE END HAS A SMALLER ELASTIC FLEXURAL CHARACTERISTIC RELATIVE TO ITS SUPPORTING END AND DEVELOPING DEVICE HAVING THE SAME

(75) Inventors: Hideki Matsumoto, Mishima; Atsushi Numagami, Hadano; Takao Nakagawa, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/422,356

(22) Filed: Oct. 21, 1999

(30) Foreign Application Priority Data

Oct. 23, 1998 (JP) ..... 10-302510

(51) Int. Cl.[7] ..... G03G 15/08
(52) U.S. Cl. ..... 399/281; 399/254
(58) Field of Search ..... 399/272, 273, 399/274, 281, 283, 284, 254; 366/97, 98, 247, 279

(56) References Cited

U.S. PATENT DOCUMENTS 5,134,411 * 7/1992 Nagata et al. ..... 399/254 X
5,177,539 * 1/1993 Tsuji ..... 399/281
5,289,237 * 2/1994 Hashizume et al. ..... 399/284
5,481,343 * 1/1996 Bhagat ..... 399/274
5,539,502 * 7/1996 Koshino et al. ..... 399/272
5,862,442 * 1/1999 Ahn ..... 399/254 X
5,893,013 4/1999 Kinoshita et al. ..... 399/284

FOREIGN PATENT DOCUMENTS 4-97379 * 3/1992 (JP) .

* cited by examiner

*Primary Examiner*—Susan S. Y. Lee
(74) *Attorney, Agent, or Firm*—Fitzpatrick, Cella, Harper & Scinto

(57) ABSTRACT

A developer feeding member feeds a developer. The developer feeding member includes an elastic sheet for feeding the developer, and a rigid supporting portion for supporting this elastic sheet. In the developer feeding member, this developer feeding member is rotatable as the supporting portion is centered as a rotation center, and a flexural rigidity of a free end of the elastic sheet is smaller than that of a portion of the elastic sheet, which is located in the vicinity of this supporting portion.

14 Claims, 7 Drawing Sheets

FIG. 6

| STRUCTURE NO. | CHARACTERISTIC | EXPERIMENT RESULT 1 | | EXPERIMENT RESULT 2 | TOTAL DECISION |
|---|---|---|---|---|---|
| | | FINE PARTICLE AMOUNT | SOLID DENSITY | AMOUNT OF REMAINING TONER WHEN "HOLLOW CHARACTERS" OCCURS | |
| STRUCTURE 1 | ROD AGITATION | 24(%) | 1.28 × | 20—30g △ | × |
| STRUCTURE 2-1 | ELASTIC SHEET THICKNESS→50 μm | 10.5(%) | 1.49 ◎ | 30—40g × | × |
| STRUCTURE 2-2 | ELASTIC SHEET THICKNESS→75 μm | 13(%) | 1.45 ○ | 20—30g △ | △ |
| STRUCTURE 2-3 | ELASTIC SHEET THICKNESS→100 μm | 13(%) | 1.44 ○ | 10—20g ○ | ○ |
| STRUCTURE 2-4 | ELASTIC SHEET THICKNESS→150 μm | 15(%) | 1.38 △ | 10—15g ○ | △ |
| STRUCTURE 2-5 | ELASTIC SHEET THICKNESS→200 μm | 19(%) | 1.30 × | 5—10g ◎ | × |
| STRUCTURE 3 | ELASTIC SHEET GETTING PROGRESSIVELY THINNER FROM 200 μm TO 20 μm | 11(%) | 1.47 ◎ | 5—10g ◎ | ◎ |
| STRUCTURE 4 | TWO-PLY OF ELASTIC SHEETS OF 200 μm AND 50 μm | 11(%) | 1.48 ◎ | 5—10g ◎ | ◎ |
| STRUCTURE 5-1 | SNICK POSITION 8mm FROM ROTATIONAL AXIS | 11(%) | 1.48 ◎ | 20—30g △ | △ |
| STRUCTURE 5-2 | SNICK POSITION 12mm FROM ROTATIONAL AXIS | 13(%) | 1.43 ○ | 10—15g ○ | ○ |
| STRUCTURE 5-3 | SNICK POSITION 16mm FROM ROTATIONAL AXIS | 17(%) | 1.33 △ | 5—10g ◎ | △ |

◎ : BETTER △ : MEDIUM
○ : GOOD × : WORSE

DEVELOPER FEEDING MEMBER WHEREIN ITS FREE END HAS A SMALLER ELASTIC FLEXURAL CHARACTERISTIC RELATIVE TO ITS SUPPORTING END AND DEVELOPING DEVICE HAVING THE SAME

BACKGROUND OF THE INVENTION

1. Field of the Invention

The present invention generally relates to a developer feeding member for feeding a developer and also to a developing device having this developer feeding member. More specifically, the present invention is directed to such a developer feeding member suitably used in an electrophotographic image forming apparatus and a process cartridge.

2. Related Background Art

In typical developing devices of image forming apparatuses such as copying machines, generally speaking, two sets of typical developer feeding members are illustratively shown in FIGS. 10A and 10B and FIGS. 11A and 11B. It should be noted that FIG. 10A and FIG. 11A are diagrams showing the developer feeding member as a single body, which is viewed from a substantially front surface, whereas FIG. 10B and FIG. 10B are cross-sectional diagrams showing the developer feeding members arranged in developer containers, which is viewed from the side direction.

The developer feeding members 1 and 11 are arranged within developer containers 2 and 12 that the developer is stored therein (the developer will be optionally referred to as "toner" hereinafter). Since these developer feeding members 1 and 11 are rotated along the arrow directions, these developer feeding members 1 and 11 may feed the developer toward developing areas (not shown) in each of which a developing sleeve and a regulating blade are provided in a left side of the corresponding drawing. Also, these developer feeding members 1 and 11 may agitate the developer to crumb it at the same time when the developer is fed.

The developer feeding member 1 constructed by bending a rod member in a crank shape and shown in FIG. 10A does not have a leave high toner feeding ability. This developer feeding member 1 is usually used in the developer container 2 having such a shape that, as represented in FIG. 10B, toner contained inside this developer container may be relatively easily fed to the developing area, namely the developer container 2 having the shape capable of feeding a certain amount of toner with the aid of only the gravity.

On the other hand, the developer feeding member 11 shown in FIG. 11A has a very a superior toner feeding ability. This developer feeding member 11 is structured in such a manner that a proximal end "A" of an elastic sheet 11*g* is fixed on a rigid body 11*a* of a rotational center portion. Since the developer feeding member 11 has very superior toner feeding ability, this developer feeding member 11 is usually employed in another developer container 12 having such a shape (see FIG. 11B) by which the toner contained in this developer container 12 cannot be easily fed to the developing area, namely the developer container 12 having the shape, by which this toner can be hardly fed with the aid of only the gravity. In this case, since the toner must be positively fed, an elastic sheet having a relatively high flexural rigidity is frequently used.

The developer container 12 of FIG. 11B may have a merit in that the weight of the toner itself contained in the developer container 12 is not given to the developing area. However, the dimension of this developer container 12 increases, thereby being not so popularly used in recent years.

However, for instance, in laser beam printers for producing images using laser beams, there is a trend that an image density is decreased under an initial use state of developing units (in such a state that much toner exists in the developer container), while the needs of making "fine particles of the developer" and of increasing "process speed" are emphasized so as to realize high image qualities for improving 1-dot reproducibility.

The major cause of lowering of this image density could be investigated by the inventors. That is, in the initial use state, there is a trend that the toner having a relatively small particle diameter contained in a developer container is collected to places in the vicinity of a developing sleeve. As a result, triboelectricity distribution of the toner coated on this developing sleeve is broadened (namely, a ratio of the toner having optimum triboelectricity to be developed is reduced). As a result, the developing ability is lowered. Thus, existence of the toner having small particle diameter may cause a problem, generally speaking, the smaller average particle diameter of the toner becomes, the more the above-described phenomenon is emphasized not only under the initial use state.

It was also confirmed that in the case where such patterns in which small amount of toner is consumed, are continuously printed out, this phenomenon is emphasized. For instance, the density of a solid black image becomes lower, which is printed out immediately after some blank copy images are continuously printed out. This is because the smaller the toner consumption amount becomes, the larger the fine particle amount present in the vicinity of the developing sleeve is increased.

Furthermore, it was confirmed that this phenomenon is further emphasized when a process speed is increased. This is considered such that developing time per unit area is shortened because of the increased process speed. Even in the case where such trends are more enhanced that "the particle diameter of he developer is made as small" and "process speed is made to be high", as a first solution idea capable of solving such a problem of density reduction, the diameters of particles of the toner are made uniform (namely, fine particles of the toner are excluded upon manufacturing). However, this solution will cause various difficulties. That is, the yield achieved when the toner is manufactured will be very lowered, and higher manufacturing cost will be required, which never constitutes a realistic solution.

As a consequence, in order to avoid such a state that fine particles contained in the toner stored in the developer container are collected to the places in the vicinity of the developing sleeve, the following method may be conceived. That is, a large amount of fresh toner contained in the developer container is not fed to the places in the vicinity of the developing sleeve within the developing area.

As one of these realistic solution methods, there is such a method for lowering the toner feeding ability to the developing area.

When the toner feeding ability is lowered, it was recognized that the above-explained problem could be solved. In contrast, however, there arises such a problem in that even though the toner remains within the developing container, there is no toner in the vicinity of the developing sleeve within the developing area, which causes "follow characters (edge effects)" in an image, and a sufficiently large amount of toner could not be fed to the developing area. As a result, the toner remaining amount in the vicinity of the developing area becomes uneven state in a longitudinal direction (namely axial direction of the developing sleeve), for example, much toner is left at a center portion, whereas less toner is left at both end portions.

When such an uneven state occurs, even if a sufficient amount of the toner is left in the developer container, since the toner remaining amount is locally small, the following problems will occur. That is to say, the quality of the toner located in the vicinity of the developing sleeve and the regulating blade in the places of the small amount toner are deteriorated. As a result, such defective images are readily produced that the image density is lowered due to toner deterioration, and the "follow characters (edge effects)" caused by toner depletion occur.

As previously described, when "feeding ability" is weakened, there is a merit in that the lowering of the density of image at "an initial use state" can be prevented from occurring. However, there is a possibility that when "feeding ability" is weakened, the defective images are produced under "substantially completely used state" (in other words, when an amount of developer contained in the developer container is small).

To avoid such a problem, the following methods may be conceived. That is, the toner in the developer container is continuously fed to the developing area by a user, and/or the developer container itself is vibrated by the user in order to avoid such a condition that the toner remaining amount becomes uneven in the longitudinal direction. However, these solution methods are not realistic methods in view of user ability.

As apparent from the foregoing descriptions, the following functions of a developer feeding member are desirably expected. That is to say, this developer feeding member may have lower "feeding ability" under an "initial use state", and furthermore, may have higher "feeding ability" under "substantially completely used state".

SUMMARY OF THE INVENTION

The present invention has been made to solve the above-described problems, and therefore, has an object of the invention to provide a developer feeding member and a developing device equipped with such a developer feeding member, capable of preventing density from being lowered under an initial use state, and further capable of preventing density from being lowered and also an occurrence of "follow characters (edge effect)" under substantially completely used state.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 6 is a list for showing experimental results obtained with respect to the sheet feeding members having various constructions in accordance with the embodiment 1;

DESCRIPTION OF THE PREFERRED EMBODIMENTS

Figure 1:
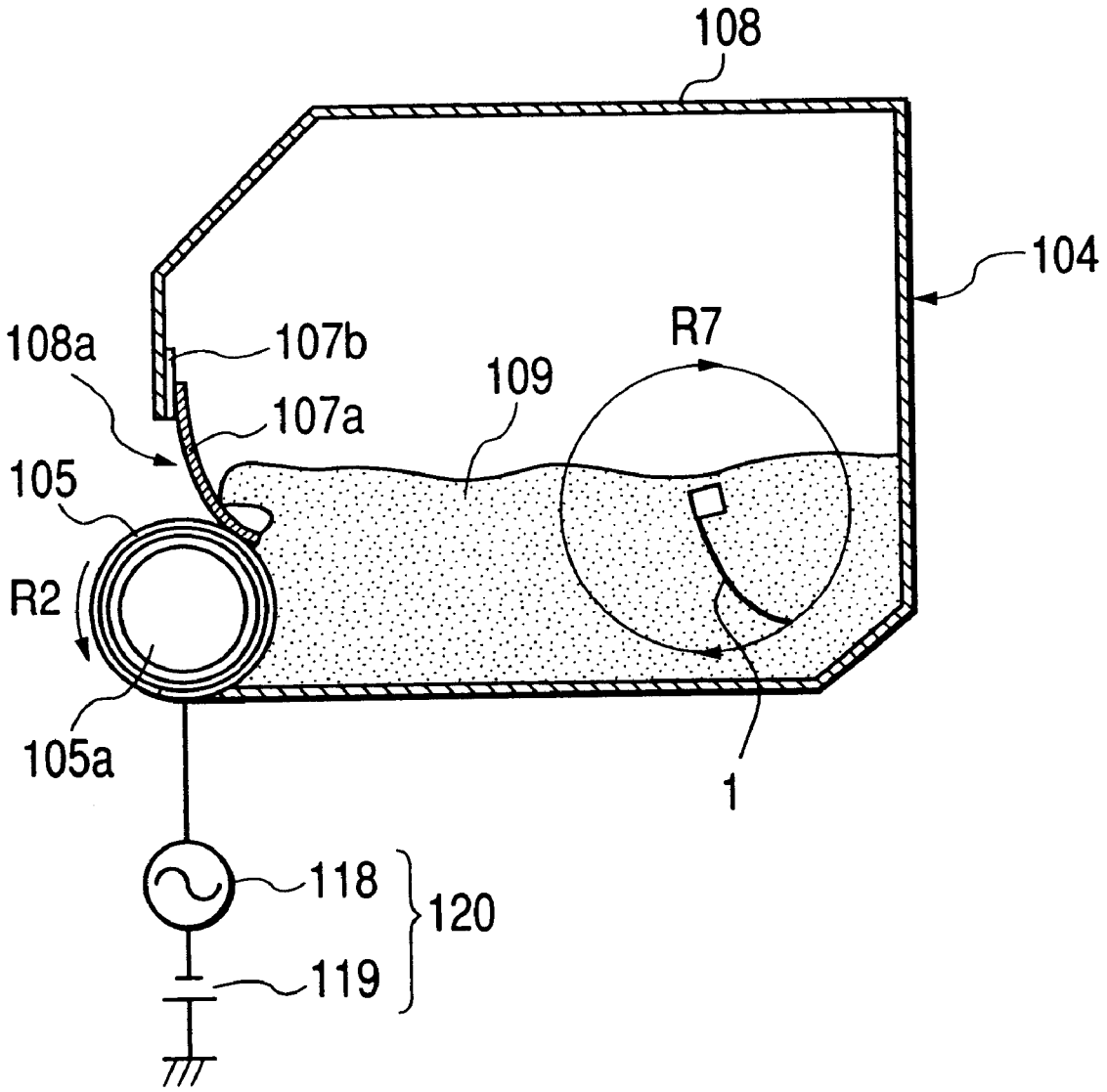
FIG. 1 is a vertical sectional view schematically showing the structure of a developing device according to an embodiment 1 of the present invention.

Referring now to the drawings, the embodiments of the present invention will be described.

EMBODIMENT 1

Figure 2:
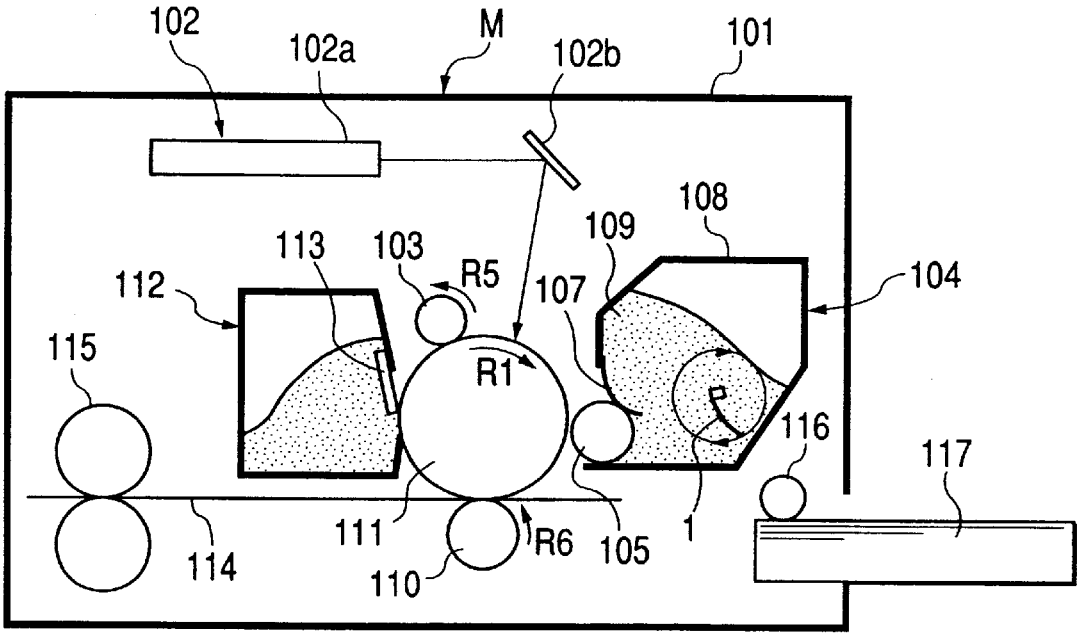
FIG. 2 is a vertical sectional view schematically showing the structure of an image forming apparatus according to the embodiment 1.

FIG. 1 schematically shows an example of a developing device according to the embodiment 1 of the present invention. That is, FIG. 1 is a vertical sectional view schematically showing the construction of the developing device. Also, FIG. 2 schematically shows an example of an image forming apparatus, according to the present invention, provided with this developing device. FIG. 2 is a vertical sectional view schematically showing the structure of the image forming apparatus.

First, the entire arrangement of the image forming apparatus "M" will now be described with reference to FIG. 2. Subsequently, the developing device 104 will be explained in more detail with reference to FIG. 1.

In the image forming apparatus M shown in this drawing, a drum-shaped electrophotographic photosensitive member 111 (will be referred to as a "photosensitive drum" hereinafter) functioning as an image bearing member is provided inside a main body 101 of the image forming apparatus. The photosensitive drum 111 is rotatably driven by drive means (not shown) in a direction indicated by an arrow R1. This photosensitive drum 111 is uniformly charged with a predetermined polarity and at a predetermined potential by a charging device 103. This charging device 103 is arranged in contact with the surface of this photosensitive drum 111 so as to be rotated by the rotation of the photosensitve drum 111 in a direction indicated by an arrow R5.

An electrostatic latent image is formed on the surface of the charged photosensitive drum 111 by an exposure device 102. The exposure device 102 contains a laser scanner 102*a*, a reflection mirror 102*b*, and the like. In response to image information, this exposure device 102 exposes the surface of the photosensitive drum 111 to form the electrostatic latent image on this exposed surface by turning ON/OFF the laser light.

The electrostatic latent image formed on the photosensitive drum 111 is developed by the developing device 104. A developing bias produced by superimposing a DC bias and an AC bias is applied between the photosensitive drum 111 and a developing sleeve 105 by a developing bias application power supply 120 (see FIG. 1). As a result, an alternate electric field is formed between the developing sleeve 105 and the photosensitive drum 111, and then a developer 109 (will be optionally referred to as "toner" hereinafter) is adhered onto the electrostatic latent image formed on the photosensitive drum 111, so that this electrostatic latent image is developed as a toner image. It should be noted that the developing device 104 will be explained in detail.

The toner image formed on the photosensitive drum 111 is transferred to a transfer material 114 such as paper by a transfer device 110 rotated in a direction indicated by an arrow R6. A transfer bias is applied to this transfer device 110 by a transfer bias application power supply (not shown). As a result, this transfer device 110 applies electric charges having an opposite polarity to that of the toner image to a back surface of the transfer material 114, so that the toner image formed on the photosensitive drum 111 may be transferred to the transfer material 114. This transfer material 114 may be conveyed to the transfer device 110 in such a way that the transfer material 114 such as paper stored in a sheet feed cassette 117 is fed by a sheet pick-up roller 116, and then is conveyed in synchronism with the toner image formed on the photosensitive drum 111 by using a registration roller (not shown).

The transfer material 114 to which the toner image has been transferred is heated and pressured by a fixing device 115, so that this toner image is fixed on the surface of this transfer material 114.

On the other hand, as to the photosensitive drum 111 on which the toner images have been transferred, toner which have not been transferred to the transfer material 114, but are left on the surface of this photosensitive drum 111 are removed by a cleaning blade 113 of a cleaning device 112. Then, this cleaned photosensitive drum 111 is prepared for the next image forming operation.

The entire construction of the image forming apparatus M has been explained in the above description.

Next, the developing device 104 will now be described by mainly referring to FIG. 1, and properly referring to FIG. 2.

That is, the developing device 104 shown in FIG. 1 is provided with the developer container 108, the developing sleeve (namely, developing bearing member) 105, and the developer feeding member 1. The developer container 108 contains the toner 109. The developing sleeve 105 is arranged at an opening portion 108*a* of the developing container 108 and bears a toner on the surface of the developing sleeve, and then feeds the borne toner to a developing position. The developer feeding member 1 is arranged in the developer container 108 so as to feed the toner 109 contained in the developer container 108 toward the above-explained developing sleeve 105.

This developing sleeve 105 may be a sleeve made of aluminum having a non-magnetic characteristic, and also having a diameter of 16 mm. The surface of this developing sleeve 105 is coated by a resin layer containing conductive particles. The developing sleeve 105 is rotatably driven by drive means (not shown) in the direction indicated by the arrow R2. Inside the developing sleeve 105, a 4-pole magnetic roll 105*a* is arranged so as to hold a toner on the surface of the developing sleeve 105. A regulating blade 107*a* functioning as a developer regulating member abuts against the surface of the developing sleeve 105. This regulating blade 107*a* is such a silicone rubber made in a plate-like shape and having a JIS-regulated hardness of approximately 40 degrees. A proximal end of this regulating blade 107*a* is fixed onto a supporting sheet metal 107*b*, and a distal end of this regulating blade 107*a* abuts against the developing sleeve 105 while keeping an abutment force of 30 to 40 gf/cm (namely, abutment load, or linear load per 1 cm in the longitudinal direction of the developing sleeve). As a result, the thickness of the toner layer borne on the surface of this developing sleeve 105 is regulated.

As the above-described toner, a negative-charged magnetic monocomponent toner is employed. As the component of this toner, into 100 parts by weight of styrene-n-butyle acrylate copolymer as binder resin, 80 parts by weight of magnetic particles, 2 parts by weight of negative charge control agent of mono-azo based iron complex, and 3 parts by weight of low molecular weight polypropylene as a wax are melted and mixed with a 2-axis extruder heated at a temperature of 140° C. Then, the cooled mixture is coarsely ground by a hammer mill, and the coarsely ground particle is finely ground with a jet mill. The resultant finely ground particle is subjected to an air classification, so as to obtain classified particle having a weight-averaged diameter of 5.0 $\mu$m. 1.0 part by weight of hydrophobic silica fine particle is mixed with the classified particle of the averaged particle diameter of 5.0 $\mu$m with the Henschel Mixer to produce toner (developer). Then, the toner having weight-averaged particle diameters within a range of 3.5 to 7.0 $\mu$m (mainly on the order of 6 $\mu$m) are used.

As the developing bias voltage applied to the developing sleeve 105 by the developing bias application power supply 120, in such a case that a gap formed between the photosensitive drum 111 and the developing sleeve 105 is selected to be, for example, on the order of 300 $\mu$m, such a superimposed voltage is applied to this gap. This superimposed voltage is produced by superimposing a DC voltage of −500 V produced from a DC power supply 119, with an AC voltage produced from an AC power supply 118, namely a rectangular wave peak-to-peak voltage of 1,600 $V_{pp}$ having a frequency of 2,200 Hz. The surface of the photosensitive drum 111 before being developed is charged by using the above-explained charging device 103 in such a manner that the charged potential (namely, dark section potential) "$V_D$" is equal to −600 V. Furthermore, a light section potential of the exposed portion becomes equal to $V_L$=−150 V, which is exposed by the laser beam of the exposing device 102. To the contrary, the above-explained superimposed voltage is applied to the developing sleeve 105 by the developing bias application power supply 120, so that a so-called "reversal development" is carried out by which the toner is adhered onto the light section.

Also, the toner feeding member (developer feeding member) 1 is arranged inside the developer container 108. This toner feeding member 1 feeds the toner 109 contained in the developer container 108 toward the developing sleeve 105, and also agitates the toner 105. The toner feeding member 1 is rotated at a rotating speed of one revolution per six (6) seconds in a direction indicated by an arrow R7, and may feed the toner to such a developing area where the developing sleeve 105 is located while crumbing up the toner contained in the developer container 108.

The present invention is featured by constructing the toner feeding member 1 under optimum conditions. That is, even in such a case that "developer is made as fine particle" aiming the high image qualities capable of improving 1-dot reproducibility, and "process speed is increased", this toner feeding member 1 can feed the toner contained in the developer container 108 into the developing area under optimum conditions. As a consequence, this invention can suppress occurrences of deteriorations in image qualities, namely "lowering of density" under an "initial use state", and also "follow characters" under "substantially completely used state".

While the above-explained image forming apparatus M and developing device 104 are used, the following evaluation as to the toner feeding member 1 and the image quality was carried out in accordance with the below-mentioned experimental conditions as well as experimental methods:

EXPERIMENT 1

Examination/confirmation of Lowering of Initial Density

Experimental Environment: At temperature of 23° C. and humidity of 60%.

Process Speed of Image Forming Apparatus "M": 120 mm/sec.

Rotating Speed of Toner Feeding Member 1: 8 rpm.

(Experimental Method)

1. First, in the developing device 104 assembled with the below-mentioned toner feeding member 1, 10 sheets of blank copy images are formed (outputted). An object of this blank copy image is to increase the fine particle amount in the vicinity of the developing sleeve 105 in order to emphasize low density (concentration).
2. One sheet of a solid black image is outputted from the image forming apparatus, and image density of this solid black image is measured. A purpose of this solid black image is to confirm an effect with respect to lowering of density at an initial state. The density measuring operation was carried out by employing the Macbeth reflection densitometer manufactured by Macbeth Co., Ltd.
3. After 10 sheets of blank copy images are again outputted from the apparatus, a toner sample on the developing sleeve 105 is extracted, and then, the amount of fine particles contained in this toner sample is measured. The purpose of this particle measured is to judge whether or not the prospective effect may be achieved based upon a total amount of fine particles which may directly cause lowering of the density. In order to measure a diameter of a toner particle, while employing the Coulter Multisizer manufactured by Coulter K. K., such a toner particle having a particle diameter smaller than, or equal to 3.2 μm may be judged as "fine particle", and a ratio of this fine particle is calculated. It should be noted that as the toner used in this experiment, the containing ratio of the fine particle amount (particle diameter being smaller than, or equal to 3.2 μm) was approximately 13% at the manufacturing stage.
4. Thereafter, 30 sheets of solid black images are outputted from the apparatus. While observing a sample, it is so judged whether or not fading occurs, and also how degree this fading occurs.

EXPERIMENT 2

Examination/confirmation of Image Failure During the Latter Half of Endurance

Experimental Environment: At temperature of 32.5° C. and humidity of 80%.

Process Speed of Image Forming Apparatus "M": 120 mm/sec.

Rotating Speed of Toner Feeding Member 1: 8 rpm.

(Experimental Method)

1. In the developing device 104 assembled with the below-mentioned toner feeding member 1, an image whose printing ratio is selected to be on the order of 4% is outputted so as to consume toner.
2. At such a time instant when the surface of the developing sleeve 105 cannot be coated by the toner, and thus "follow characters (edge effects)" occur on an image, an amount of toner contained in the developer container 108 is measured.

(Structure of Toner Feeding Member 1)

A distance defined from a rotational center (rotational axis) up to a bottom of the developer container =20 mm.

Structure 1: Rod-shaped Member

Figure 10A:
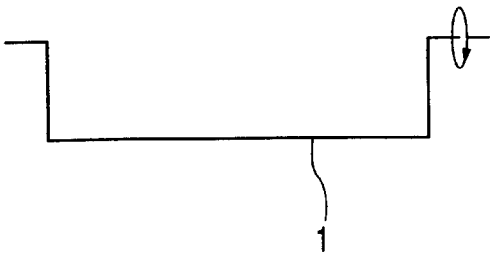
FIG. 10A is a front view schematically showing the conventional rod-shaped sheet feeding member.
Figure 10B:
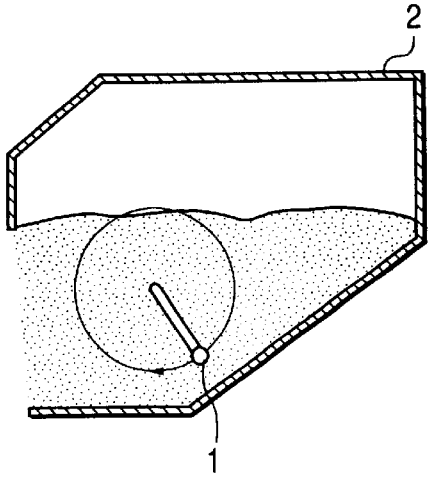
FIG. 10B is a side view schematically showing the operation of the conventional rod-shaped sheet feeding member.

As shown in FIG. 10A, the toner feeding member was constructed by bending a rod member in a crank shape. A diameter of this rod member is equal to 2 mm, and a rotational radius thereof is equal to 18 mm.

It should be understood that this rotational radius implies a distance measured from an agitating central axis up to a distal end of an elastic sheet under such a condition that toner is not agitated, whereas an agitating radius implies a distance measured from the agitating central axis up to the distal end of the elastic sheet under such a condition that the toner is agitated. As a consequence, a rotational radius is made constant in each of these structures. However, an agitating radius is changed, depending upon a specific structure.

Structure 2: Rigid rod+Single Elastic Sheet

Figure 11A:
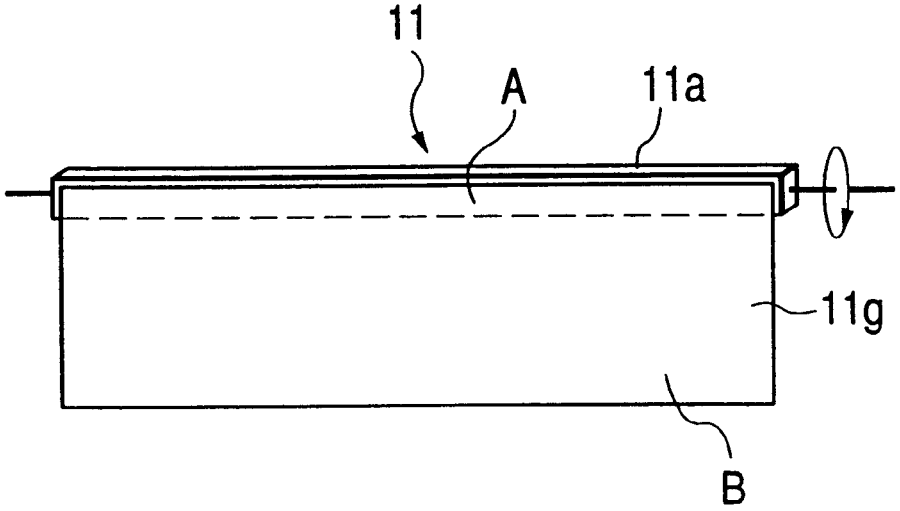
FIG. 11A is a front view schematically showing the conventional sheet feeding member using the elastic sheet.
Figure 11B:
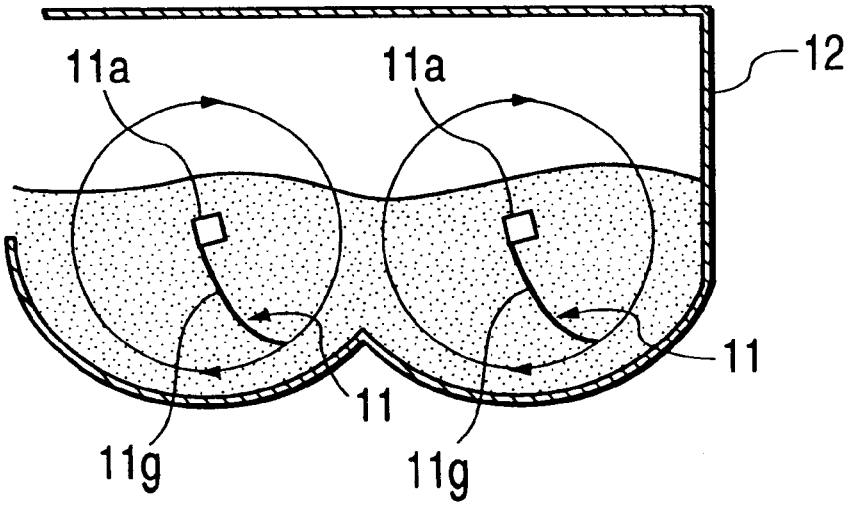
FIG. 11B is a side view schematically showing the conventional sheet feeding member using the elastic sheet.

As shown in FIG. 11A, this structure 2 of the developer feeding member is constructed in such a manner that a proximal end "A" of one sheet of an elastic sheet 11*g* is adhered (fixed) onto a rigid rod (rigid body) 11*a*, and a distal end "B" of this elastic sheet 11*g* is constituted as a free end. This rigid rod 11*a* is made in an integral body with a rotational shaft which is arranged substantially parallel to the rotational shaft of the developing sleeve 105. The rigid rod 11*a* is a rod having a square cross-section with a side size of 4 mm. Also, 5 sorts of toner feeding members 11 were constituted by using 5 sheets of elastic sheets 11*g* having different thicknesses as the elastic sheet 11*g*. The thicknesses of these elastic sheets 11*g* were selected from 50, 75, 100, 150, and 200 μm, by which developer feeding members were manufactured as a structure 2-1, a structure 2-2, a structure 2-3, a structure 2-4, and a structure 2-5 in this order. The rotational radius is made equal to 20 mm.

Structure 3: Rigid rod+Single Elastic Sheet (a Thickness of Elastic Sheet is Gradually Decreased)

Figure 3A:
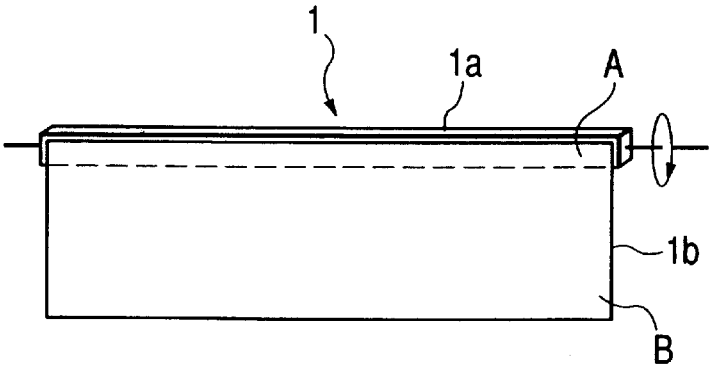
FIG. 3A is a front view schematically showing the structure of a toner feeding member in which a thickness of an elastic sheet is gradually reduced in accordance with embodiment 1.
Figure 3B:
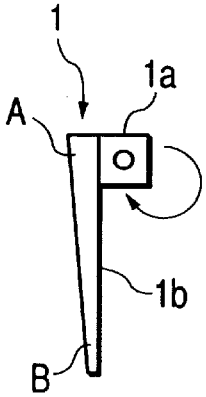
FIG. 3B is a side view schematically showing the structure of the toner feeding member in which a thickness of an elastic sheet is gradually reduced in accordance with the embodiment 1.

As shown in FIG. 3A and FIG. 3B, this structure 3 of the developer feeding member is constructed in such a manner that a proximal end "A" of one sheet of an elastic sheet 1*b* is adhered (fixed) onto a rigid rod l*a*, and a distal end "B" of this elastic sheet 1*b* is constituted as a free end. This rigid rod l*a* is identical to that of the above-explained structure 1. The thickness of this elastic sheet 1*b* is gradually reduced from 200 μm up to 20 μm, starting from the proximal end "A" thereof to the distal end "B" thereof. The rotational radius is selected to be 20 mm.

Structure 4: Rigid rod+2 Elastic Sheets

Figure 4A:
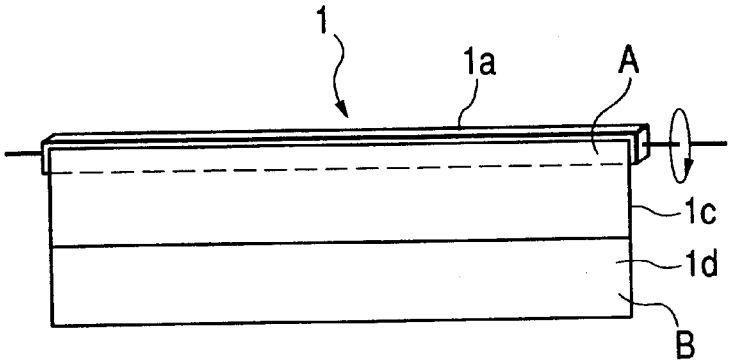
FIG. 4A is a front view schematically showing the structure of a toner feeding member having an elastic sheet made by overlapping sheet members in accordance with the embodiment 1.
Figure 4B:
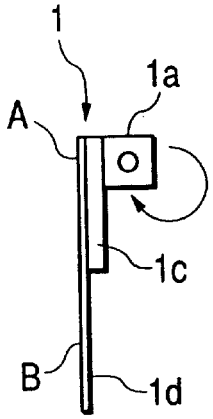
FIG. 4B is a side view schematically showing the structure of the toner feeding member having the elastic sheet made by overlapping the sheet members in accordance with the embodiment 1.

As shown in FIG. 4A and FIG. 4B, this structure 4 of the developer feeding member is constructed in such a manner that proximal ends "A" of two sheets of sheet members 1*c* and 1*d* having an elastic characteristic are adhered (fixed) onto a rigid rod l*a*, and distal ends "B" of these elastic sheet members 1*c* and 1*d* are constituted as a free end, while these two sheet members 1*c* and 1*d* are overlapped with each other. This rigid rod 1*a* is identical to that of the above-explained structure 1. The thickness of one elastic sheet member 1*c* is selected to be 200 μm, and the rotational radius is selected to be 10 mm. The thickness of the other elastic sheet member 1*d* is selected to be 50 μm, and the rotational radius is selected to be 20 mm. The length of the sheet member 1*c* provided on the upstream side in the toner feeding direction (rotation direction) was designed to be shortened.

Structure 5: Rigid rod+Single Elastic Sheet (Elastic Sheet has a Snicked Portion)

Figure 5A:
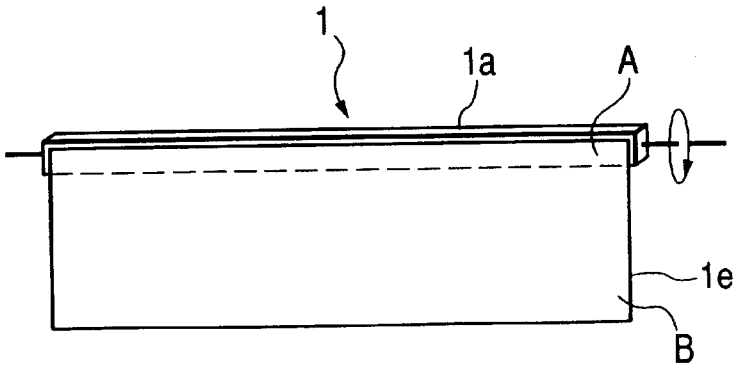
FIG. 5A is a front view schematically showing the structure of a toner feeding member having an elastic sheet where a snicked portion is formed.
Figure 5B:
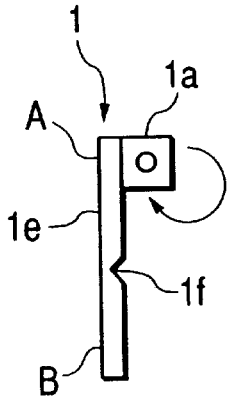
FIG. 5B is a side view schematically showing the structure of the toner feeding member having the elastic sheet where the snicked portion is formed.

As shown in FIG. 5A and FIG. 5B, this structure 5 of the developer feeding member is constructed in such a manner that a proximal end "A" of one sheet of an elastic sheet 1*e* is adhered (fixed) onto a rigid rod 1*a*, and a distal end "B" of this elastic sheet 1*e* is constituted as a free end. The rigid rod 1*a* is identical to that of the structure 1. The thickness of this elastic sheet 1*e* is selected to be 200 μm, and the rotational radius is equal to 20 mm. Furthermore, a snicked portion (flexible portion) If is formed in this elastic sheet 1*e*. This snicked portion if has a depth of 100 μm along a rotational axis, and is formed between the proximal end "A" and the distal end "B" of the surface of this elastic sheet on the upstream side in the rotational direction. As a result, the distal end "B" of this elastic sheet 1*e* can be bent from this snicked portion 1*f* with respect to the proximal end "A". 3 sorts of toner feeding members 1 were constituted in which the forming positions of the snicked portions are different from each other. The forming positions of these snicked portions 1*f* are selected to be 8, 12, and 16 mm from the rotational axis, with which a structure 5-1, a structure 5-2, and a structure 5-3 were made in this order.

It should also be noted that although PET has been employed as the material for forming the elastic sheet in this embodiment, the present invention is not limited thereto, but may be applied to other materials, for example, PEN and PI without any problem.

Next, while the toner feeding member 1 having gone of the above-described structure 1, structures 2-1 through 2-5, structure 3, structure 4, and structures 5-1 through 5-3 was used, the above-mentioned experiment 1 and experiment 2 were carried out. The experimental results are shown in a table of FIG. 6.

As apparent from this table of FIG. 6, the images having better image qualities could be formed via endurance by employing the structures made of "rigid rod +elastic sheet (structures other than structure 1)" rather than the rod agitation (structure 1).

As a basic structure, any arbitrary structures of such toner feeding members may be employed. That is, "toner feeding ability" of these toner feeding members is low under "initial use state", and furthermore, "toner feeding ability" thereof is high under "substantially completely used state".

Figure 7A:
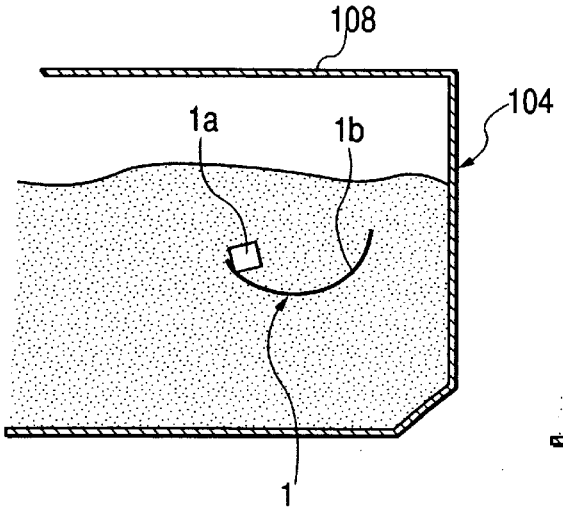
FIG. 7A illustratively shows operation of the toner feeding member in the case that much toner is provided within the developer container.

In this structure 2-1 through the structure 2-5, when the thickness of the PET sheet which constitutes the elastic sheet 11*g* is made thicker than, or equal to 150 μ(namely , structure 2-4 and structure 2-5), there is no improvement in the initial density. This may be conceived from the following fact. That is, since the flexural rigidity of the elastic sheet 11*g* becomes excessively strong, the elastic sheet 11*g* is not made flexible as shown in FIG. 7A under "initial use state", but the agitating radius is increased. As a result, a large amount of toner would be fed to the developing area.

On the other hand, when the thickness of the PET sheet is made thinner than, or equal to 75 μm (namely, structure 2-1 and structure 2-2), such an image having "follow characters" occurs at earlier stages. This may be conceived from such a fact that since the flexural rigidity of the elastic sheet 11*g* becomes weak, the toner feeding member could not firmly feed the toner to the developing area under "substantially completely used state".

Figure 7B:
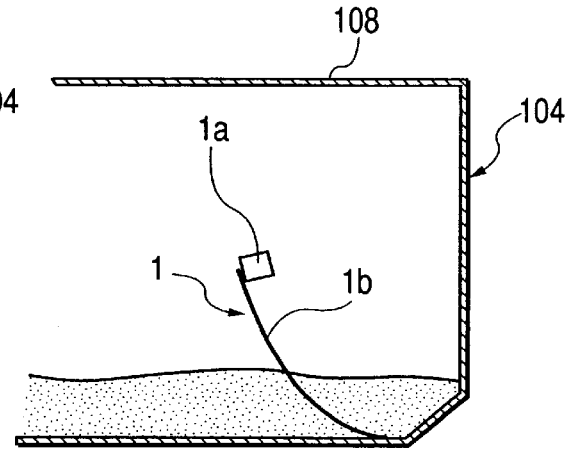
FIG. 7B illustratively shows operation of the toner feeding member in the case that less toner is provided within the developer container.

The following considerations may be established. That is, the reason why the structure 3 and the structure 4 have the better toner feeding abilities under both states, namely "initial use state" and "substantially completely used state" is given as follows. Under "initial use state", as shown in FIG. 7A, the elastic sheet 1*b* and the like are made flexible and then the agitating radius is made small, whereas under "substantially completely used state", the flexibility of this elastic sheet 1*b* becomes small, as shown in FIG. 7B, so that the agitating radius is increased and therefore, the toner can be firmly fed to the developing area.

More specifically, since the sheet member 1*c* having the strong flexural rigidity is overlapped with the sheet member 1*d* having the weak flexural rigidity in the structure 4, there is such a merit that both the agitating radius under "initial use state" and the feeding force under "substantially completely used state" can be firmly controlled by properly adjusting the length (position of distal end) of the sheet member 1*c* having the strong flexural rigidity along the radial direction thereof.

In other words, even in developing devices with any types of developing characteristics, when it is desirable to increase the density of an image under "initial use state" the length of the sheet member 1*c* having the strong flexural rigidity along the radial direction is made short, so that the agitating radius is reduced. On the other hand, when the feeding force of the toner feeding member is desired to be increased, under "substantially completely used state" the length of the sheet member 1*c* having the strong flexural rigidity along the radial direction is made long. It should be understood that also in this case, the elongated length of this sheet member 1*c* must be made shorter than the length of the sheet member 1*d* having the weak flexural rigidity along the radial direction.

In the structure 5-1 to the structure 5-3, it can be seen that the performance of the toner feeding members under both "initial use state" and "substantially completely used state" is changed, depending upon the forming position of the snicked portion 1*f*. The reason of these structures 5-1 through 5-3 is similar to that of the structure 4. The forming position of the snicked portion 1*f* may give influences to the agitating radius even under "initial use state", and also to the feeding force under "substantially completely used state".

It can be understood from the above-explained experimental results that the toner feeding members 1 having the structure 3 and the structure 4 could have extremely high effects.

However, these experimental results may differ from each other, depending upon the toner particle diameter, the process speed, the material used as the elastic sheet, and the shape of the developer container 108. Nevertheless, there is no change in the relative evaluation trend of total decisions in the toner feeding members 1 having the structures 1 to 5 as shown in FIG. 6.

As previously described in detail, in accordance with the developing device 104 of this embodiment mode 1, it could be confirmed such a fact that since "toner delivering force (toner feeding force)" is varied in accordance with the remaining amount of the toner contained in the developer container 108, the image having the better image qualities could be provided during the endurance.

Alternatively, in the above-explained sheet feeding member 1 having the structure 4, the elastic sheet may be arranged by overlapping more than 3 sheets of sheet members. For example, 3 sheets of sheet members having different lengths along the radial direction may be overlapped with each other in such a manner that the sheet member having the shortest length is firstly overlapped with the sheet member having the second shortest length, and thereafter with the sheet member having the longest length in the order from the upstream side along the rotation direction. This alternative example implies that a total number of overlapped sheet members at the proximal end "A" becomes larger than a total number of overlapped sheet members at the distal end "B". With employment of such an alternative structure, the toner feeding force of the sheet feeding member may be furthermore adjusted in a fine mode, as compared with that achieved when two sheets of the sheet members are overlapped with each other.

Also, in the sheet feeding member 1 with the above-explained structure 5, a weak portion instead of the snicked portion may be formed at the position where the snicked portion 1*f* is originally formed. This weak portion has a locally weaker flexural rigidity strength than that of another portion. In other words, since the bending portion, for example, either the snicked portion 1*f* or the weak portion is provided, the elastic sheet 1*e* may be easily bent at this bending portion.

EMBODIMENT 2

Embodiment 2 of the present invention is featured by that the above-explained developing device 104 of the embodiment 1 is assembled into a cartridge container 6 in combination with the photosensitive drum 111, the charging device 103, and the cleaning device 112 so as to constitute a process cartridge PC.

Figure 8:
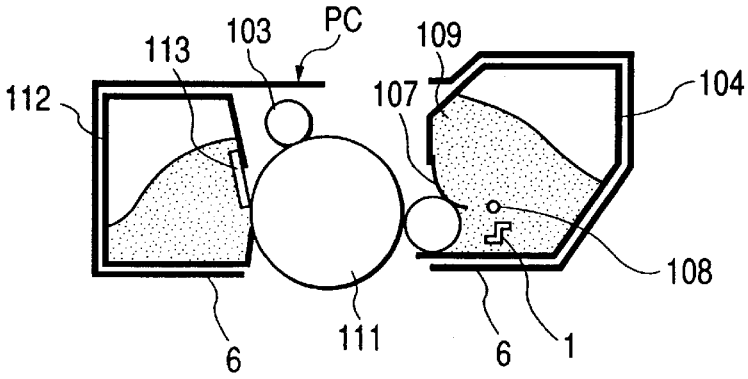
FIG. 8 is a vertical sectional view schematically showing the structure of a process cartridge in accordance with the embodiment 2 of the present invention.
Figure 9:
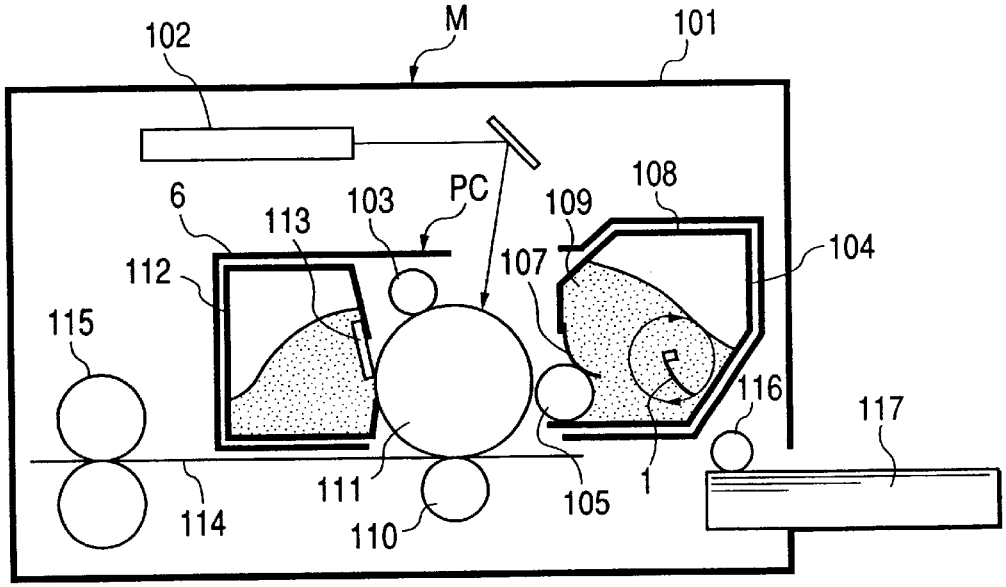
FIG. 9 is a vertical sectional view schematically showing an image forming apparatus on which the process cartridge is mounted.

FIG. 8 schematically shows an example of such a process cartridge PC. Also, FIG. 9 schematically shows such a state that the process cartridge is mounted on a main body 101 of an image forming apparatus. It should be understood that the same reference numerals used in the above-explained embodiment 1 will be employed as those for denoting the same, or similar structures shown in FIG. 8 and FIG. 9, and therefore, descriptions thereof are omitted.

As explained above, in accordance with this embodiment 2, the developing device 104, the photosensitive drum 111, the charging device 103, and the cleaning device 112 are assembled into the cartridge container 6 in an integral body, so that the process cartridge PC detachably mountable on the main body 101 of the image forming apparatus may be constituted.

In accordance with such a process cartridge PC, the lifetime of this process cartridge PC is designed in such a way that when the toner 109 contained in the developing device 108 is depleted, the lifetimes of other devices such as the photosensitive drum 111 and the cleaning device 112 can be made substantially equal to this lifetime of the process cartridge PC. As a consequence, while the toner is contained in the process cartridge PC, there is a merit that the image can be continuously produced under stable condition. Moreover, there is another merit that since the process cartridge PC is manufactured in an integral form, this toner-depleted process cartridge PC can be readily replaced by new one.

Then, as a developing device to be assembled into the above-explained process cartridge PC, when the developing device 104 having the toner feeding member 1 as explained in the above embodiment 1 is employed, another merit may be additionally provided with the above-explained merit which is originally owned by such an integral-type process cartridge PC. That is, toner images having stable density can be produced by the developing device 104 according to the present invention from the initial use stage up to the use completion stage.

It should also be noted that the process cartridge PC according to the present invention is not limited to the above-explained structure, but may be applied to other structures. For instance, such a structure may be realized by assembling at least both the photosensitive drum 111 functioning as an image bearing member and the developing device 104 according to the present invention into the cartridge container 6 in an integral manner. Also, as to the process cartridge PC according to the present invention, other devices such as the charging device 103 and the cleaning device 112 may be arbitrarily assembled into the cartridge container 6.

While the invention has been described with reference to the structures disclosed herein, it is not confined to the details set forth and this application is intended to cover such modifications or changes as may come within the purposes of the improvements or the scope of the following claims.

What is claimed is:

1. A developer feeding member for feeding a developer, comprising:

an elastic sheet for feeding said developer; and a rigid supporting portion for supporting said elastic sheet, wherein said developer feeding member is rotatable as said supporting portion is centered as a rotation center, and an elastic flexural rigidity of a free end of said elastic sheet is smaller than that of a portion of said elastic sheet, which is located in a vicinity of said supporting portion, in a rotational direction of said developer feeding member.

2. A developer feeding member according to claim 1, wherein a thickness of said free end of said elastic sheet is made thinner than that of said portion thereof located in the vicinity of said supporting portion.

3. A developer feeding member according to claim 2, wherein a thickness of said elastic sheet gets progressively thinner from said portion thereof located in the vicinity of said supporting portion to said free end.

4. A developer feeding member according to claim 1, wherein said elastic sheet includes a plurality of sheet members overlapped with each other; and a total number of said sheet members provided on said portion located in the vicinity of said supporting portion is larger than that of said sheet members provided on said free end.

5. A developer feeding member according to claim 1, wherein said developer has a weight-averaged particle diameter of 3.5 to 7.0 $\mu$m.

6. A developer feeding member according to claim 1, wherein said elastic sheet comprises a first sheet having a first length in a radial direction of rotation of said developer feeding member and a second sheet having a second length larger than said first length, and an elastic flexural rigidity of said first sheet is larger than that of said second sheet.

7. A developing device comprising:

a developer container for containing therein a developer;

a developer bearing member for bearing the developer to feed the developer to a developing position; and a developer feeding member provided in said developer container, for feeding said developer toward said developer bearing member, said developer feeding member including an elastic sheet for feeding said developer, and a rigid supporting portion for supporting said elastic sheet, wherein said developer feeding member is rotatable as said supporting portion as centered as a rotation center, and an elastic flexural rigidity of a free end of said elastic sheet is smaller than that of a portion of said elastic sheet, which is located in a vicinity of said supporting portion, in a rotational direction of said developer feeding member.

8. A developing device according to claim 7, wherein a thickness of said free end of said elastic sheet is made thinner than that of said portion thereof located in the vicinity of said supporting portion.

9. A developing device according to claim 8, wherein a thickness of said elastic sheet gets progressively thinner from said portion thereof located in the vicinity of said supporting portion to said free end.

10. A developing device according to claim 7, wherein:

said elastic sheet includes a plurality of sheet members overlapped with each other; and a total number of said sheet members provided on said portion located in the vicinity of said supporting portion is larger than that of said sheet members provided on said free end.

11. A developing device according to any one of claims 7 to 10, wherein said developing device constitutes a process cartridge in combination with an image bearing member, and said process cartridge is detachably mountable to a main body of an image forming apparatus.

12. A developing device according to any one of claims 7 to 10, wherein said developing device is provided in an image forming apparatus in combination with an image bearing member.

13. A developing device according to claim 7, wherein said developer has a weight-averaged particle diameter of 3.5 to 7.0 $\mu$m.

14. A developing device according to claim 7, wherein said elastic sheet comprises a first sheet having a first length in a radial direction of rotation of said developer feeding member and a second sheet having a second length larger than said first length, and an elastic flexural rigidity of said first sheet is larger than that of said second sheet.

* * * * *

UNITED STATES PATENT AND TRADEMARK OFFICE

CERTIFICATE OF CORRECTION

PATENT NO. : 6,289,197 B1
DATED : September 11, 2001
INVENTOR(S) : Hideki Matsumoto et al.

It is certified that error appears in the above-identified patent and that said Letters Patent is hereby corrected as shown below:

Title page,
Item [57], ABSTRACT,
Line 4, "In the developer feeding member, this" should read
-- The --.

Column 1,
Line 36, "crumb" should read -- crush --;
Line 39, "leave" should be deleted; and
Line 47, "very a" should read -- very --.

Column 2,
Line 9, "could" should read -- was --;
Line 10, "be" should be deleted;
Line 19, "problem," should read -- problem, and --;
Line 37, "he" should read -- the --; and
Line 67, "becomes" should read -- comes to be in an --.

Column 3,
Line 1, "sleeve)," should read -- sleeve); --.

Column 6,
Line 21, "is such" should read -- may be --;
Line 33, "styrene-n-butyle" should read -- styrene-n-butyl --; and
Line 49, "are" should read -- is --.

Column 7,
Line 14, "crumbing" should read -- crushing --; and
Line 61, "measured is" should read -- measurement is --.

Column 8,
Line 11, "now" should read -- to what --; and
Line 27, "instant" should be deleted.

Column 9,
Line 5, "red l*a*," should read -- red l *a*, --;
Line 7, "red l*a*," should read -- red l *a*, --;
Line 9, "up" should be deleted;
Line 17, "red l*a*," should read -- red l *a*, --;
Line 39, "If" should read -- 1f --;
Line 40, "portion if" should read -- portion 1f --; and

UNITED STATES PATENT AND TRADEMARK OFFICE

CERTIFICATE OF CORRECTION

PATENT NO. : 6,289,197 B1
DATED : September 11, 2001
INVENTOR(S) : Hideki Matsumoto et al.

It is certified that error appears in the above-identified patent and that said Letters Patent is hereby corrected as shown below:

Column 9 cont'd,
Line 57, "gone" should read -- one --.

Column 10,
Line 7, "150 μ(namely," should read -- 150 μm (namely, --.

Column 13,
Line 21, "as" (first occurrence) should read -- is --.

Signed and Sealed this

Twenty-first Day of January, 2003

JAMES E. ROGAN
*Director of the United States Patent and Trademark Office*